US006385878B1

(12) United States Patent
Key

(10) Patent No.: US 6,385,878 B1
(45) Date of Patent: May 14, 2002

(54) ROTATABLE LABEL SYSTEM INCLUDING TAMPER-EVIDENT FEATURE AND METHOD FOR CONSTRUCTING SAME

(75) Inventor: Stephen M. Key, Oakdale, CA (US)

(73) Assignee: Stephen Key Design, LLC, Oakdale, CA (US)

( * ) Notice: Subject to any disclaimer, the term of this patent is extended or adjusted under 35 U.S.C. 154(b) by 0 days.

(21) Appl. No.: 09/247,245

(22) Filed: Feb. 9, 1999

(51) Int. Cl.[7] ..... G09F 3/00
(52) U.S. Cl. ..... 40/306; 40/310; 40/506
(58) Field of Search ..... 40/306, 310, 312, 40/506, 324; 206/901; 215/252, 256

(56) References Cited

U.S. PATENT DOCUMENTS

| | | | |
|---|---|---|---|
| 736,035 A | 8/1903 | Stevenson | |
| 1,064,576 A | 6/1913 | Washburn | |
| 1,312,611 A | 8/1919 | Chess | |
| 1,334,031 A | 3/1920 | Hahn | |
| 1,387,625 A | 8/1921 | Stein | |
| 1,486,313 A | 3/1924 | Van Antwerp | |
| 2,013,616 A | 9/1935 | Rettenmeyer | |
| 2,129,364 A | 9/1938 | Simons et al. | |
| 2,441,607 A | 5/1948 | Walls | |
| 2,468,000 A | 4/1949 | Taylor | |
| 2,504,076 A | 4/1950 | Lindblom | |
| 2,706,464 A | 4/1955 | North | |
| 2,739,564 A | 3/1956 | North | |
| 2,844,893 A | 7/1958 | Keller | |
| 2,860,431 A | 11/1958 | Barnum | |
| 2,931,657 A | 4/1960 | Lewis | |
| 2,935,814 A | 5/1960 | Freeze | |
| 2,971,283 A | 2/1961 | Parker | |
| 3,278,182 A | 10/1966 | Lescher | |
| 3,374,911 A | 3/1968 | White | |
| 3,488,880 A | 1/1970 | Taylor | |
| 3,542,229 A | 11/1970 | Beyerlein et al. | |
| 3,604,584 A | 9/1971 | Shank | |
| 3,733,002 A | 5/1973 | Fujio | |
| 3,960,713 A | 6/1976 | Carey | |
| 4,044,889 A | 8/1977 | Orentreich et al. | |
| 4,203,240 A | 5/1980 | Goodwin | |
| 4,381,615 A | 5/1983 | Lonsmin | |
| 4,405,045 A | 9/1983 | Villa-Real | |
| 4,505,497 A | 3/1985 | Katzman | |
| 4,567,681 A | 2/1986 | Fumei | |
| 4,658,974 A | 4/1987 | Fujita et al. | |
| 4,724,973 A | 2/1988 | Shah | |
| 4,877,119 A | 10/1989 | Hosking | |
| 5,076,613 A | 12/1991 | Kovacs | |
| 5,154,448 A | 10/1992 | Griffin et al. | |
| 5,324,559 A | 6/1994 | Brombacher | |
| 5,342,093 A | 8/1994 | Weernink | |
| 5,403,636 A | 4/1995 | Crum | |
| 5,605,230 A | 2/1997 | Mariano et al. | 206/534 |
| 5,712,021 A | 1/1998 | Hernandez | 428/192 |

FOREIGN PATENT DOCUMENTS

| | | | |
|---|---|---|---|
| DK | 85214 | 3/1958 | |
| EP | 0285514 | 10/1988 | G09F/3/02 |
| FR | 965522 | 9/1950 | |
| FR | 1114750 | 12/1955 | |
| FR | 1347102 | 11/1963 | |
| FR | 2460260 | 1/1981 | B65D/25/36 |
| FR | 2677786 | 12/1992 | G09F/3/02 |
| IT | 327286 | 7/1935 | |

*Primary Examiner*—Cassandra H. Davis
(74) *Attorney, Agent, or Firm*—Carr & Ferrell LLP; Susan Yee

(57) ABSTRACT

A rotatable label system includes a container having a removable closure and a shell of heat-shrinkable material arranged about the container. The shell has a tamper-evident portion which extends over at least a portion of the closure to prevent its removal. The remainder of the shell comprises a rotatable label portion having indicia disposed thereon. The rotatable label portion is provided with at least one transparent window through which co-located indicia disposed on an inner label affixed to the container may be viewed. The rotatable label portion is rotatable relative to the container about a vertical axis thereof to enable viewing of a selected subset of the indicia disposed on the inner label. At least one perforation line divides the tamper-evident portion of the shell from the rotatable label portion and facilitates detachment of the tamper-evident portion.

30 Claims, 11 Drawing Sheets

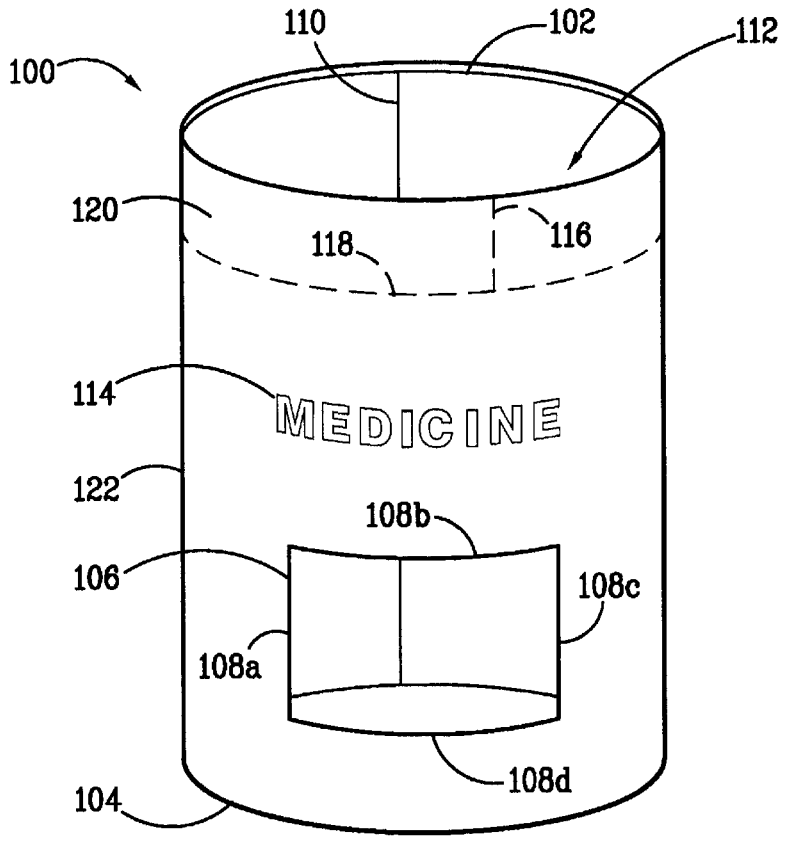
FIG. 1
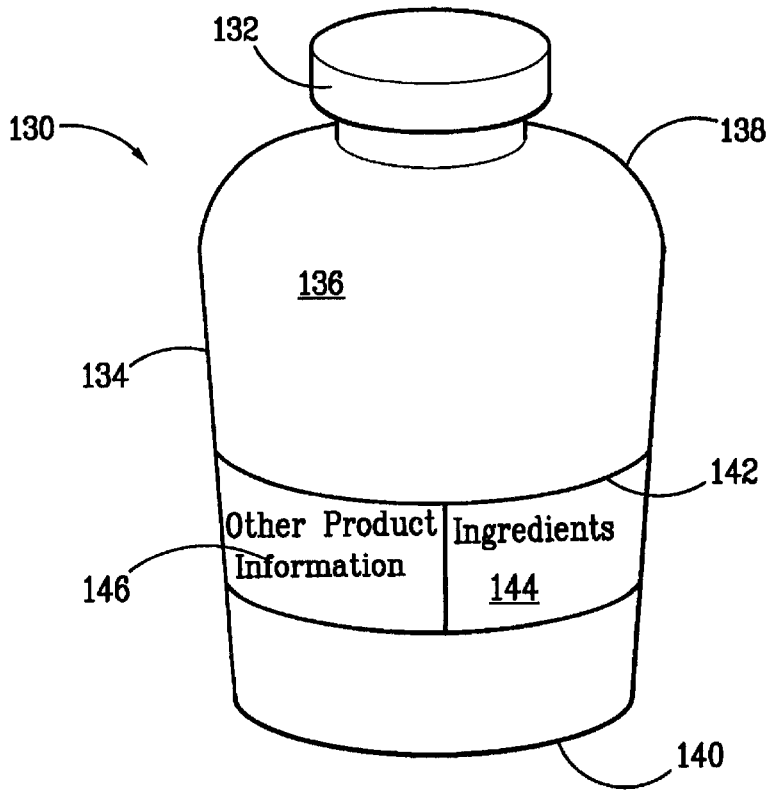

804
806b
806a
810
808
800
812
Product Ingred mation
814
802
820
822
824
826
830b
830a

ROTATABLE LABEL SYSTEM INCLUDING TAMPER-EVIDENT FEATURE AND METHOD FOR CONSTRUCTING SAME

CROSS-REFERENCE TO RELATED PATENTS AND APPLICATIONS

The present application is related to and incorporates by reference the following patents and patent applications: U.S. Pat. No. 5,809,674 issued Sep. 22, 1998, for an invention entitled "Apparatus and Method for Increasing an Effective Information Carrying Surface Area on a Container"; U.S. patent application Ser. No. 08/741,607 filed on Oct. 31, 1996 entitled "Apparatus and Method for Constructing a Rotatable Label Device"; U.S. patent application Ser. No. 09/126,010 filed on Jul. 29, 1998 entitled "Rotating Label System and Method"; and U.S. patent application Ser. No. 09/187,299 filed Nov. 5, 1998 entitled "Rotatable Label System and Method for Constructing the Same."

BACKGROUND OF THE INVENTION

1. Field of the Invention

The present invention relates generally to labels and more particularly to a rotatable label system having a tamper-evident feature.

2. Description of the Background Art

Many consumer products, such as vitamins, medication, and food items are packaged in containers. It is usually desirable to display information in the form of written indicia arranged on the exterior surface of such containers to inform consumers as to the nature and use of the associated product. This information may include directions for use, warnings, dosage amounts, ingredients, company logos, and advertisements. Such information is conventionally printed on a label affixed to the container.

A problem associated with conventional labels is that insufficient area is available to accommodate all of the information which a manufacturer desires to provide to the consumer. Of course, the manufacturer may include all of the desired information on the label by reducing the size or typeface of some or all of the indicia, or by closely spacing the indicia. However, reduction of the size of text and/or graphics may adversely affect the visual appeal of the container, or may render some or all of the information illegible to the consumer. Furthermore, consumers may tend to ignore information presented in "fine print."

A manufacturer who wishes to provide a relatively large amount of information to the consumer may also opt to to place some of the information on a separate sheet of paper (known as an "insert") packaged with the container. This technique is commonly employed in connection with health care items, such as over-the-counter medications and contact lens solutions. However, the insert is frequently lost or discarded after the initial use of the associated product, thus causing information set forth thereon to becomes unavailable to the consumer.

An additional goal of product packaging is to prevent the products being tampered with prior to reaching the consumer. Tamper-protection is conventionally achieved by providing a tamper-evident seal or film which must be ruptured or removed in order to gain access to the contents of the container. The rupture or removal of the tamper-evident feature visually indicates to the consumer that the contents may have been previously accessed, and the consumer is thus warned not to purchase or use the product.

In view of the foregoing discussion, there is a need in the product packaging art for a system for increasing the amount of information which can be presented on a product container. There is a more specific need for label system having augmented surface area for presenting written information and an integrated tamper-evident feature.

SUMMARY OF THE INVENTION

The present invention avoids or substantially alleviates the aforementioned deficiencies associated with prior art labels by providing a rotatable label system having an integral tamper-evident portion. The rotatable label system generally includes a container for holding a quantity of a consumer product, and a shell of heat-shrinkable material (referred to herein as "shrink-wrap" material) disposed about the exterior of the container and conforming thereto. The shell is preferably adapted with a set of perforation lines, including at least one horizontally oriented perforation line extending circumferentially about the container which divides the shell into a tamper-evident portion and a rotatable label portion. The perforations define lines of weakening which enable a user to quickly and easily detach the tamper-evident portion of the shell from the rotatable label portion thereof. The container is conventionally provided with a removable closure, such as a cap. An upper margin of the tamper-evident portion of the shell extends over a corresponding portion of the cap such that the cap may only be removed by first detaching the tamper-evident portion from the remainder of the shell.

The rotatable label portion of the shell includes at least one transparent window which, when the rotatable label is rotated relative to the container about a central vertical axis thereof, allows selective viewing of co-located indicia arranged on the exterior of the container (either on an inner label affixed to the container, or placed directly on an outer surface of the container). Additional indicia is disposed on regions of the rotatable label portion outside of the window. Because indicia may be placed both on the inner label and on the rotatable label portion of the shell, the manufacturer may advantageously provide a substantially increased amount of information to the consumer.

The present invention also encompasses various methods for constructing a label system of the foregoing description. According to a first method, a cylindrical sleeve of shrink-wrap material, adapted with at least one perforation line defining a tamper-evident portion and a rotatable label portion, is placed over the container and longitudinally aligned therewith such that an upper margin of the sleeve extends over at least a portion of the cap. Heat is then applied to the sleeve to cause it to conform to the container, with the tamper-evident portion covering at least part of the cap. The diameter of the sleeve, as well as the duration and conditions of the heat-shrinking process, are carefully controlled such that the resultant shell does not adhere to the container and the rotatable label portion can be easily rotated relative to the container. In certain embodiments of the invention, the container is shaped or provided with surface features to inhibit vertical displacement of the shell.

According to another method of constructing the label system, a flat sheet of shrink-wrap material is provided having at least one perforation line dividing a tamper-evident portion from a rotatable label portion. A vertically-oriented leading edge of the sheet is contacted with an adjacent portion of the container and held stationery relative thereto while the sheet is wrapped around the container such that a trailing edge of the sheet meets or overlaps the leading edge. Heat is then applied to the sheet to cause it to conform to the container and cap in the manner described above.

The rotatable label system of the invention advantageously provides increased label surface area for presenting product information and combines a label and a tamper-evident element into a single structure. Other advantages and features of the present invention will be apparent from the drawings and detailed description as set forth below.

BRIEF DESCRIPTION OF THE DRAWINGS

FIG. 1 is a perspective view of a first embodiment of the rotatable label system of the present invention, showing in particular the shell and container components prior to assembly;

DETAILED DESCRIPTION OF PREFERRED EMBODIMENTS

Figure 3:
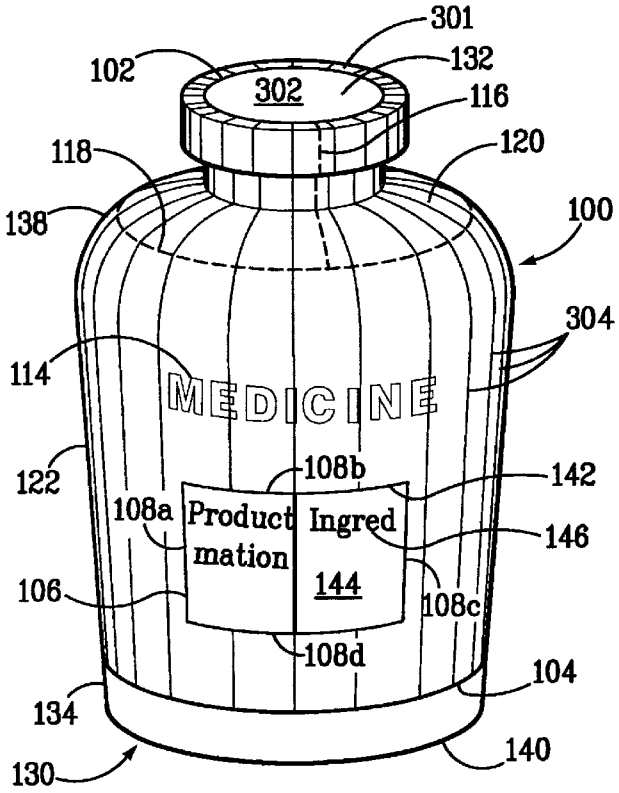
FIG. 3 is a perspective view of the container and shell of FIG. 1 with the shell heat-shrunk about the container.
Figure 2:
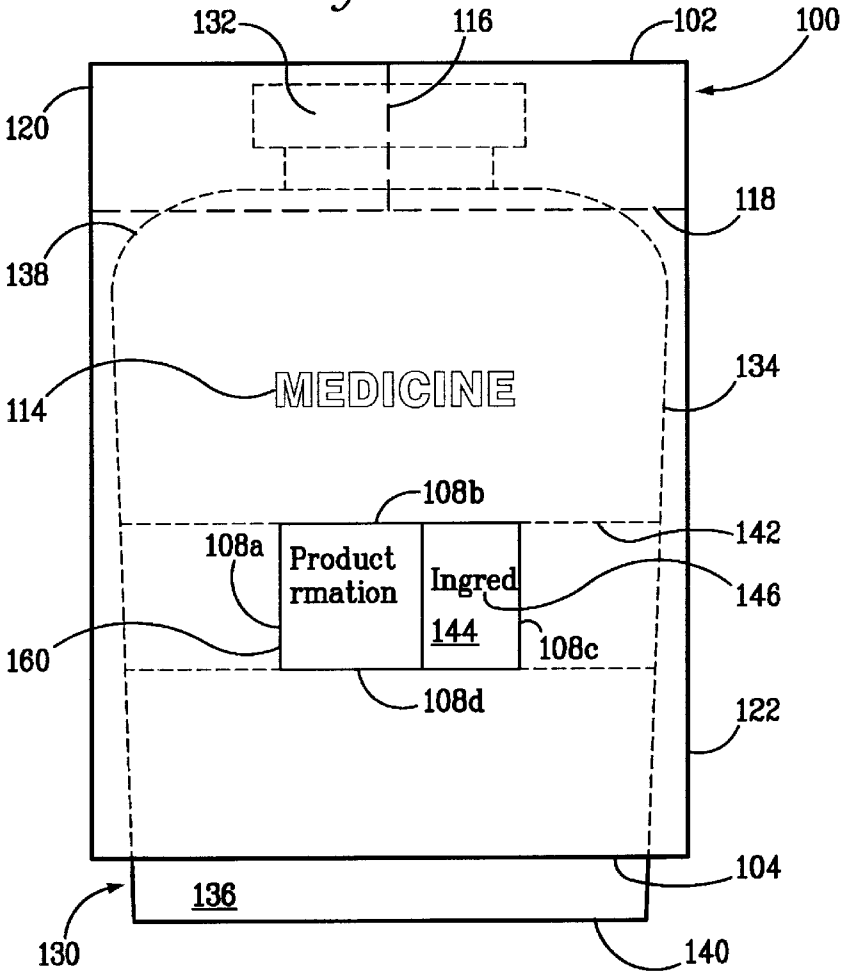
FIG. 2 is a front view of the shell and container of FIG. 1 wherein the shell is positioned about the container.

The present invention will now be described with reference to preferred embodiments thereof. FIGS. 1–3 illustrate a rotatable label system and a first method for forming the same. In FIG. 1, the components of the label system are shown prior to assembly thereof. The label system generally comprises a shell 100 fabricated of a heat-shrinkable material and a conventional container 130. The shell 100 is initially formed into a generally tubular shape extending between a top edge 102 and a bottom edge 104 and defining a chamber 112 interiorly thereto. The shell 100 may be fabricated from a generally rectangular sheet of heat-shrinkable material, such as PVC film, by thermal welding or otherwise joining the opposed edges of the sheet along a seam 110.

The shell 100 is substantially non-transparent and has arranged thereon written indicia 114. The written indicia 114 may typically include textual information such as the product name, ingredients or directions for use, or graphic information such as ornamental designs, company logos and the like. The written indicia 114 is preferably printed on the shell 100 using conventional silk-screening or lithographic methods.

The shell 100 is additionally adapted with perforation lines 116 and 118 and a transparent window 106. One of the perforation lines 118 has a generally horizontal orientation and extends around the circumference of the shell 100. As will be discussed in greater detail hereinbelow, the horizontal or circumferential perforation line 118 divides the shell 100 into an upper tamper-evident portion and a lower rotatable label portion. The second perforation line 116 extends generally vertically from the horizontal perforation line 118 to the upper edge 102 of the shell.

The transparent window 106 of the shell 100 is defined by window edges 108*a–d*. The window 106 may be formed of a substantially transparent heat-shrinkable material, or may alternatively comprise an open area formed in the rotatable label section of the shell. The window 106 may also be formed or uncovered by removal of a predetermined section of the shell, as will be discussed in connection with FIG. 12*b*. It is to be noted that while only one transparent window 106 is depicted in the figures, the present invention includes within its scope embodiments of a label system having a plurality of windows. As is discussed in further detail hereinbelow, the window 106 enables viewing of an underlying subset of indicia 146 disposed on the exterior of the container 130.

The container 130 conventionally includes a closure, such as a cap 132, which may be removed from a body 134 of the container 130 to allow the user to gain access to the container's contents. According to one embodiment of the invention, the body 134 is provided with a shoulder 138 having a broadened dimension. The body 134 of the container 130 tapers downwardly from the shoulder 138. Although the body 134 of the container 130 is shown as having a generally circular cross-section, those skilled in the art will appreciate that the cross-sectional shape of the container is not essential to practicing the invention, and that other cross-sectional shapes, such as rectangular or elliptical, may be substituted for the circular cross-section.

FIG. 1 further illustrates an inner label 142 affixed to the exterior surface 136 of the container 130. The inner label 142 has an outer surface 144 with written indicia 146 disposed thereon. In a manner similar to written indicia 114, the written indicia 146 may include textual or graphic information such as the product name, directions for use, company logos, and ornamental designs. Those skilled in the art will appreciate that the written indicia 146 may alternatively be disposed (via printing or other suitable techniques) directly on the exterior surface 136 of the container 130.

FIG. 2 shows a front view of the shell 100 positioned about the container 130 prior to heat-shrinking the shell 100. It is noted that the shell 100 is sized such that the container 130 may be received within the chamber 112 defined interiorly of the shell 100. It is further noted that the shell 100 is longitudinally positioned with respect to the container 130 such that the top edge 102 of the shell 100 is located above a top surface 302 of the cap 132. This longitudinal positioning of the shell causes an upper margin of the shell 100 to cover an adjacent portion of the top surface 302 of the cap 132 (thereby preventing the cap 132 from being removed from the body 134 of the container 130) when the shell 100 is heat shrunk. Additionally, FIG. 2 shows that when the container 130 is properly longitudinally positioned with respect to the container, an underlying subset of the written indicia 146 disposed on the inner label 142 appears within the transparent window 106.

FIG. 3 is a perspective view of the label system in its finished configuration following heat shrinking of the shell 100. As shown, the tamper-evident portion 120 of the shell 100 conforms to a corresponding portion of the body 134 including the shoulder 138. An upper margin 301 of the shell 100 covers an adjacent portion of the top surface 302 of the cap 132. The horizontal perforation line 118 contracts around the shoulder 138 of the container 130 such that the horizontal perforation line 118 is located above the widest expanse of the shoulder 138, thereby preventing downward displacement of the rotatable label portion. While the shell 100 is depicted as terminating in a bottom edge located above the bottom 140 of the container 136, the shell 100 may optionally be extended downwardly such that a lower margin of the shell 100 covers a corresponding portion of the container bottom 140 to thereby prevent upward displacement of the shell 100 relative to the container 136.

Those skilled in the art will recognize that a number of factors may be adjusted to control the shrinkage of the shell 100 during the heat shrinking process. These factors include the initial dimensions of the shell 100, the material(s) from which the shell 100 is fabricated, the duration of the heat shrinking process, and the conditions (temperature, etc.) under which heat shrinking is performed. It is further appreciated that a slip agent may be applied between the rotatable label portion 122 of the shell 100 and the adjacent surfaces of the container 136 and/or inner label 142 to prevent sticking of the rotatable label portion to the shell 100 and thereby ensure that the rotatable label portion 122 of the shell 100 is free to rotate about the container 130.

If desired, a bead of adhesive may be disposed between the tamper-evident portion 120 of the shell 100 and the adjacent surfaces of the container 130 to inhibit rotation of the shell 100 relative to the container 130 prior to detachment of the tamper-evident portion 120.

FIG. 3 shows the transparent window 106 positioned such that an underlying subset of written indicia 146 located on the outer surface 144 of the inner label 142 is viewable through the transparent window 106. As discussed in connection with FIG. 2, the transparent window 106 should be positioned at the appropriate vertical position relative to the container 136 such that the written indicia will be properly framed within the window.

Figure 4:
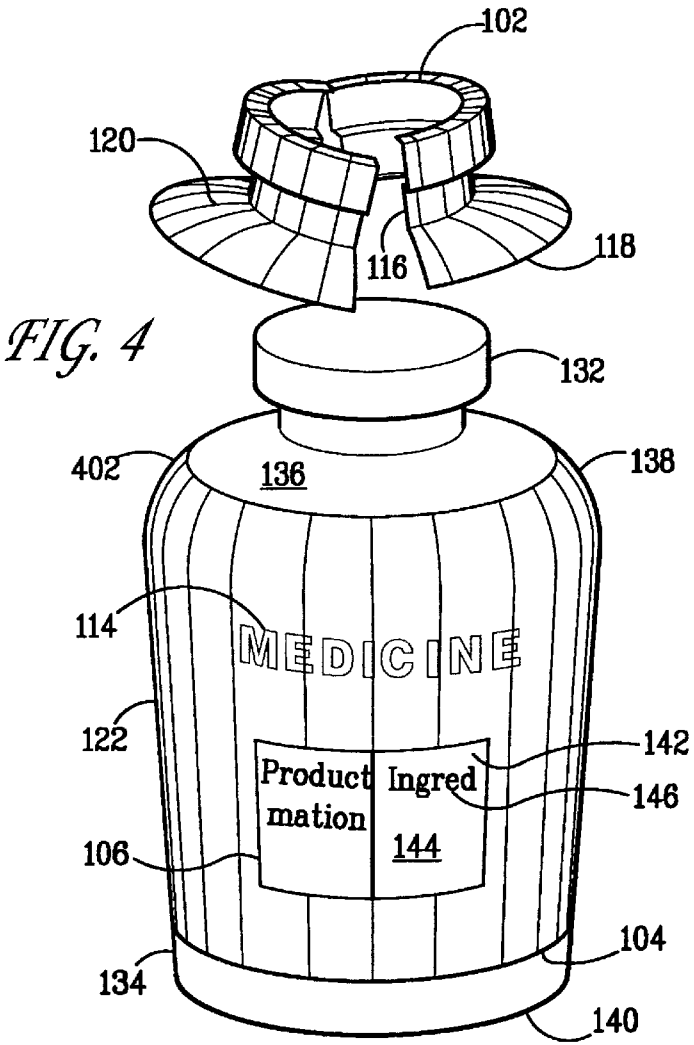
FIG. 4 is a perspective view of container and shell of FIG. 3, with the tamper-evident portion removed.

FIG. 4 is a perspective view of the rotatable label system wherein the tamper-evident portion 120 of the shell 100 has been detached and removed from the rotatable label portion 122. As discussed in connection with FIG. 1, the shell is provided with at least one horizontal perforation line 118 extending circumferentially around the container, and at least one generally vertical perforation line 116 extending from the horizontal perforation line 118 to the upper edge 102 of the shell. The perforation lines 116 and 118 form lines of weakening enabling a user to easily separate the tamper-evident portion from the rotatable label portion.

Because the cap 132 cannot be removed from the body 134 of the container 130 without first detaching the tamper-evident portion 120 of the shell 100, the presence of an intact tamper-evident portion 120 assures the purchaser that the cap 132 has not been previously removed. Conversely, a partially or fully detached tamper-evident portion 120 indicates to the purchaser that the cap 130 may have been removed and the contents of the container 130 accessed.

After the tamper-evident portion 120 has been detached from the shell 100, the rotatable label portion 122 remains rotatably disposed about the container 130 and is longitudinally maintained on the container 130 by the curved shoulder 138 and the downward taper of the body 134. In this configuration, the curved shoulder 138 prevents the rotatable label portion 122 from moving downward because the diameter at a top portion 402 of the rotatable label portion 122 is smaller than the diameter of the curved shoulder 138 at its widest expanse. Similarly, the taper of the body 134 of the container 130 prevents the rotatable label portion 122 from moving upward because the diameter of the bottom edge 104 of the rotatable label portion 122 is smaller than the diameter of the container 130 in the upward longitudinal direction. Another method for securing the rotatable label portion 122 about the container 130 is to provide a curved shoulder proximal the bottom 140 of the container 130. Those skilled in the art will recognize that many other shape configurations may be utilized to prevent longitudinal displacement of the rotatable label portion.

Figure 5:
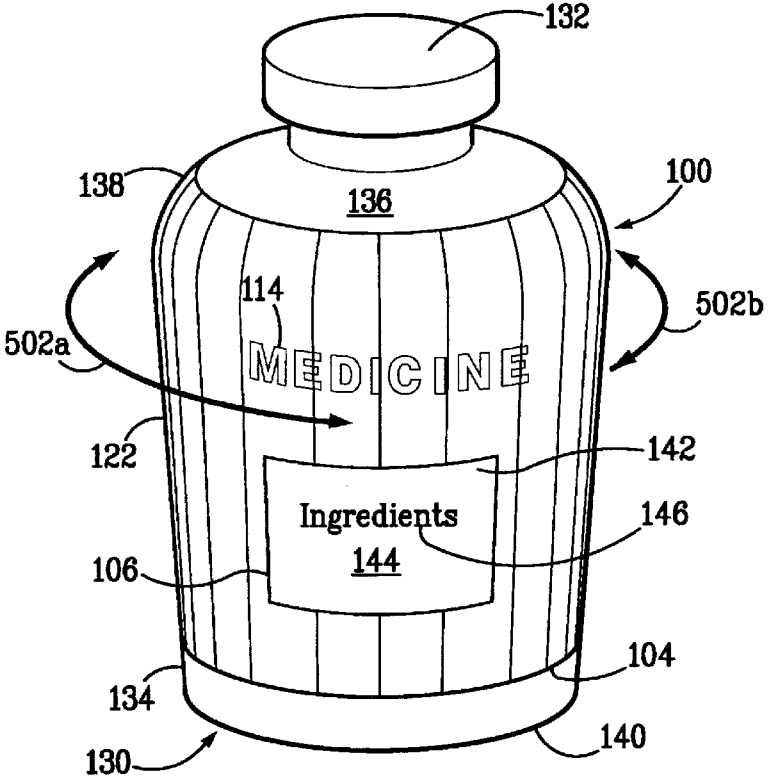
FIG. 5 is a perspective view of the container and shell of FIG.4, with the rotatable label portion of the shell rotated with respect to the container.

FIG. 5 illustrates the rotatable label system wherein the rotatable label portion 122 has been rotated relative to the container 130. As discussed above in connection with FIGS. 1–3, the transparent window permits a user to view an underlying subset of indicia 146 disposed on an inner label affixed to the container 130. The user selects which subset of indicia 146 he or she wishes to view by rotating the rotatable label portion 122 such that the selected subset of indicia appears within the window. As depicted in the figures, the written indicia 146 may include several subsets (product information, ingredients, and the like) circumferentially arranged about the inner label, each subset being selectively viewable by the user.

Figure 6:
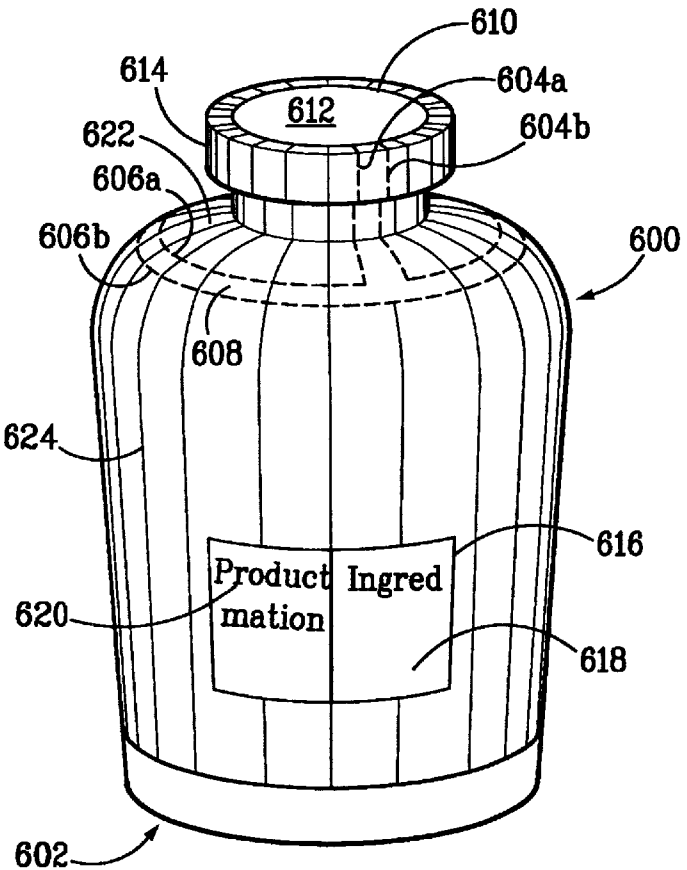
FIG. 6 is a perspective view of another embodiment of the rotatable label system, showing a shell heat-shrunk about a container.

FIG. 6 illustrates another embodiment of a shell 600 heat-shrunk about a container 602. In this embodiment, the shell 600 is adapted with two vertical perforation lines 604*a* and 604*b* and two horizontal perforation lines 606*a* and 606b which collectively define a perforation portion 608. An upper margin 610 of the shell 600 covers a corresponding portion of a top surface 612 of a cap 614. The shell 600 also includes a transparent window 616 through which an inner label 618 with written indicia 620 disposed thereon is viewable.

Figure 7:
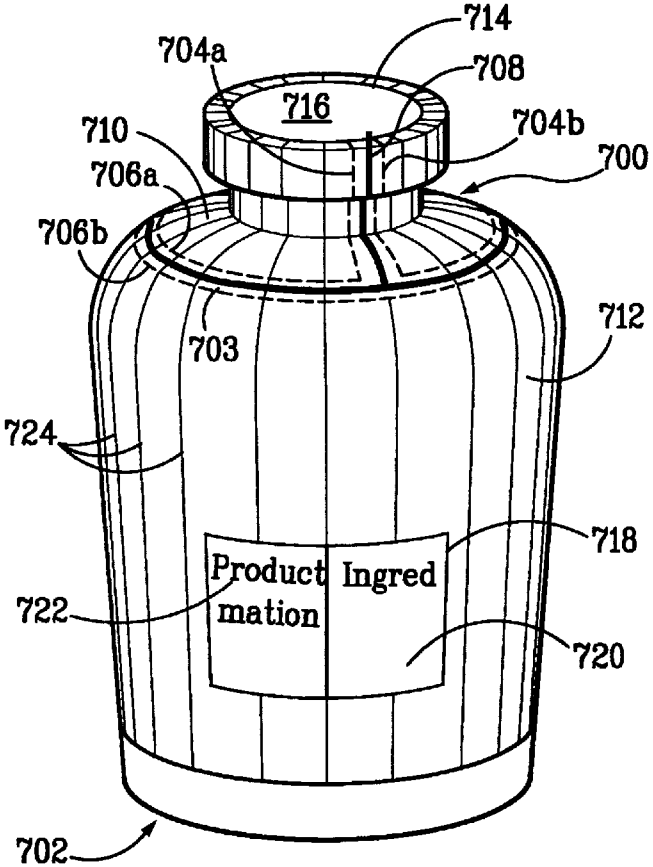
FIG. 7 is a perspective view of still another embodiment of the rotatable label system, showing shell heat-shrunk about a container.

In accordance with the embodiment depicted in FIG. 7, the perforation portion 608 must be removed to enable detachment of the tamper-evident portion 622. Once the tamper-evident portion 622 is detached, a rotatable label 624 remains disposed about the container 602 and is rotatable relative thereto to permit the user to selectively view a subset of written indicia 620 disposed on the inner label 618.

FIG. 7 illustrates another embodiment of a shell 700 heat-shrunk about a container 702. A perforation portion 703 defined by vertical perforation lines 704*a* and 704*b* and horizontal perforation lines 706*a* and 706*b* is substantially identical to that found in the embodiment described in FIG. 6. The FIG. 7 embodiment additionally provides a release tab 708 which is affixed to the perforation portion 703. The release tab 708 terminates beyond a top of the perforation portion 703 in a free end which may be manually grasped by a user. Pulling on the release tab 708 causes the perforation portion 703 to be detached from the remainder of the shell 700, thereby enabling removal of a tamperevident portion 710 from a rotatable label 712 of the shell 700.

Figures 8A, 8B, 8C:
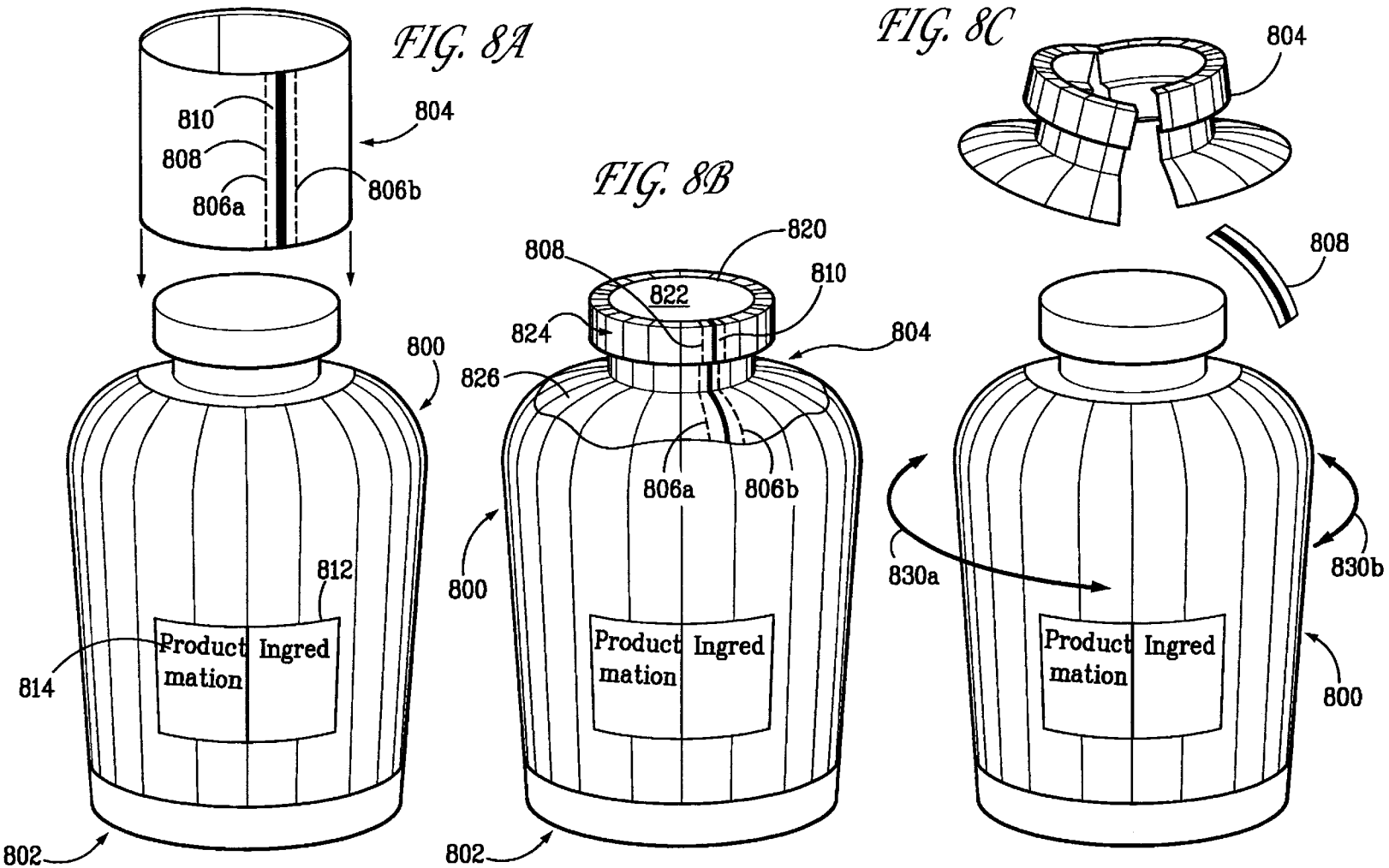
FIG. 8*a* is a perspective view of yet another rotatable label system having rotatable label with a separate tamper-evident portion.
FIG. 8*b* is a perspective view of the rotatable label and the separate tamper-evident portion of FIG. 8*a* heat-shrunk about a container.
FIG. 8*c* is a perspective view of the rotatable label and the separate tamper-evident portion of FIG. 8*a* with the tamper-evident portion removed.

FIG. 8*a* is a perspective view of a rotatable label 800 with a separate tamper-evident portion 804. As illustrated, a lower shell or rotatable label 800 is heat-shrunk about a container 802. The rotatable label 800 comprises a transparent window 812 through which is displayed written indicia 814 disposed on the container 802.

Unlike the previous embodiments, the lower shell 800 does not contain any perforation lines. Instead an upper shell or tamper-evident portion 804 is utilized to prevent tampering with the container 802. The tamper-evident portion 804 contains vertical perforation lines 806*a* and 806*b* which form a perforation portion 808. Positioned along the perforation portion 808 is a release tab 810.

FIG. 8*b* is a perspective view of the rotatable label 800 with the separate tamper-evident portion 804 heat-shrunk about the container 802. An upper margin 820 of the tamper-evident portion 804 is contracted over a portion of a top surface 822 of a cap 824 removably attached to the container 802. A lower margin 826 of the tamper-evident portion 804 overlaps a part of the rotatable label 800. The overlap prevents the rotatable label 800 from easily rotating about the container 802.

As illustrated in FIG. 8*c*, the tamper-evident portion 804 may be removed from around the cap 824 and top portion of the container 802 by detaching the perforation portion 808 from the tamper-evident portion 804. The tamperevident portion 808 is removed from around the container 802 by first removing the perforation portion 808 along the vertical perforation lines 806*a* and 806*b*. Then, the remainder of the tamper-evident portion 808 will easily come away from the container 802. Once the tamper-evident portion 804 is removed from about the container 802, the rotatable label 800 is free to rotate relative to the container 802 as indicated by arrows 830*a* and 830*b*. Although the arrows 830*a* and 830*b* show a clockwise rotation as viewed from the top, one will appreciate that the rotatable label 800 may be rotated in the counterclockwise direction as well.

Figure 9:
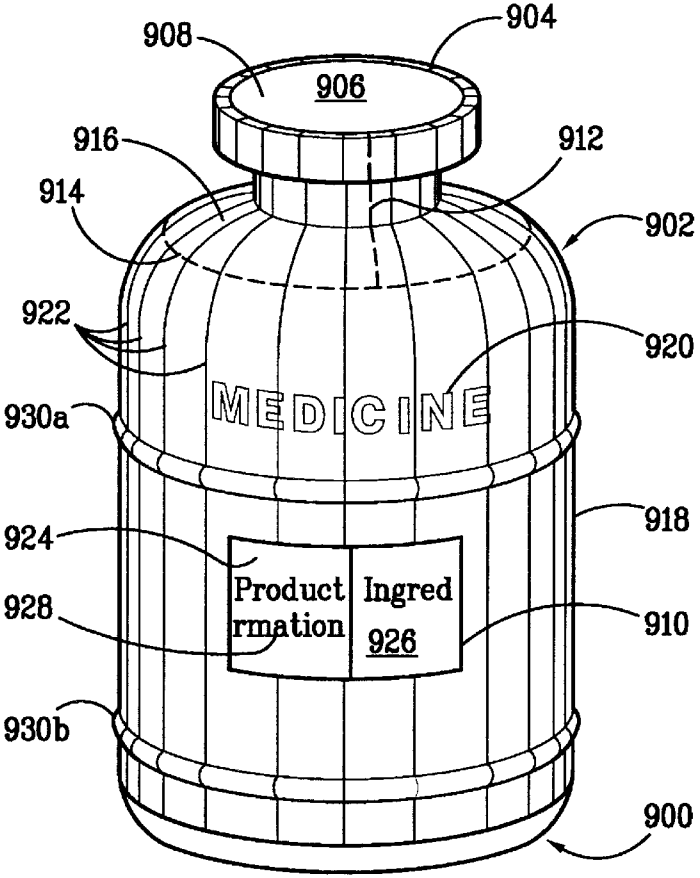
FIG. 9 is a perspective view of yet another embodiment of the rotatable label system, showing a shell heat-shrunk about a container.

FIG. 9 illustrates another embodiment of the rotatable label system including a shell 902 heat-shrunk about a container 900. This embodiment is closely similar to the embodiment depicted in FIGS. 1–5 and described hereinabove. However, in the FIG. 9 embodiment, the container 900 does not have a tapered body. Rather, surface contours 930*a* and 930*b* are provided to prevent upward displacement of the rotatable label portion 918 relative to the container 900 after detachment of the tamper-evident portion. The portion of the shell 902 that covers these surface contours 930*a* and 930*b* shrink to a diameter that is different than portions of the shell 902 covering the rest of the container 900. Because the diameters of the shell 902 in the region of the surface contours 930*a* and 930*b* are larger than in other regions of the container 900, the shell 902 is restrained from moving longitudinally. Thus, the surface contours 930*a* and 930*b* longitudinally maintain the rotatable label 918 about the container 900.

Figure 10:
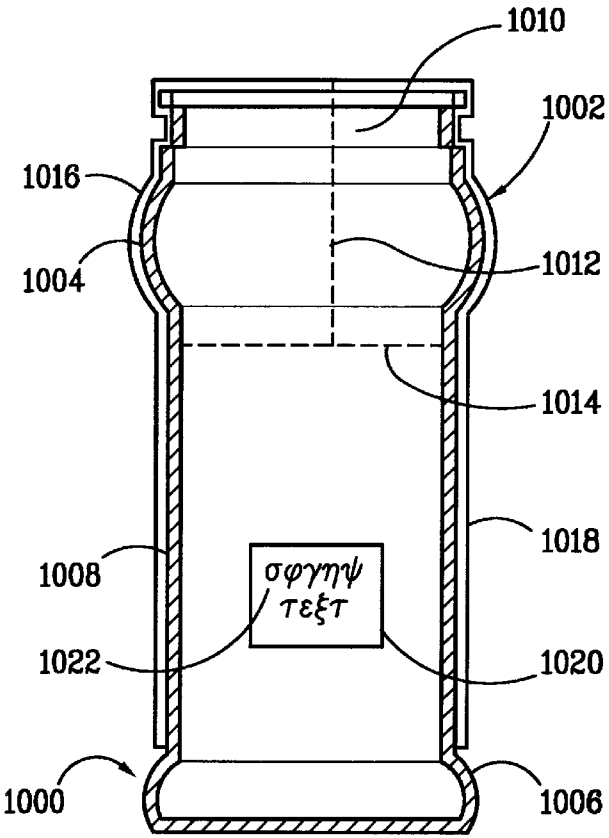
FIG. 10 is a cross-sectional view of yet another embodiment of the rotatable label system, showing a container with a shell heat-shrunk about the container.

Although FIG. 9 shows the surface contours 930*a* and 930*b* as being continuous raised rims extending circumferentially around the container 900, those skilled in the art will recognize that different shapes, numbers and arrangements of surface contours may be utilized to inhibit longitudinal movement of the rotatable label from a preferred position. For example, FIG. 10 shows (in cross-sectional view) a container 1000 having top and bottom boundary elements 1004 and 1006 each having an enlarged diameter. The rotatable label portion of the shell extends between the boundary elements and is thereby maintained in the desired longitudinal position on the container.

Figure 11:
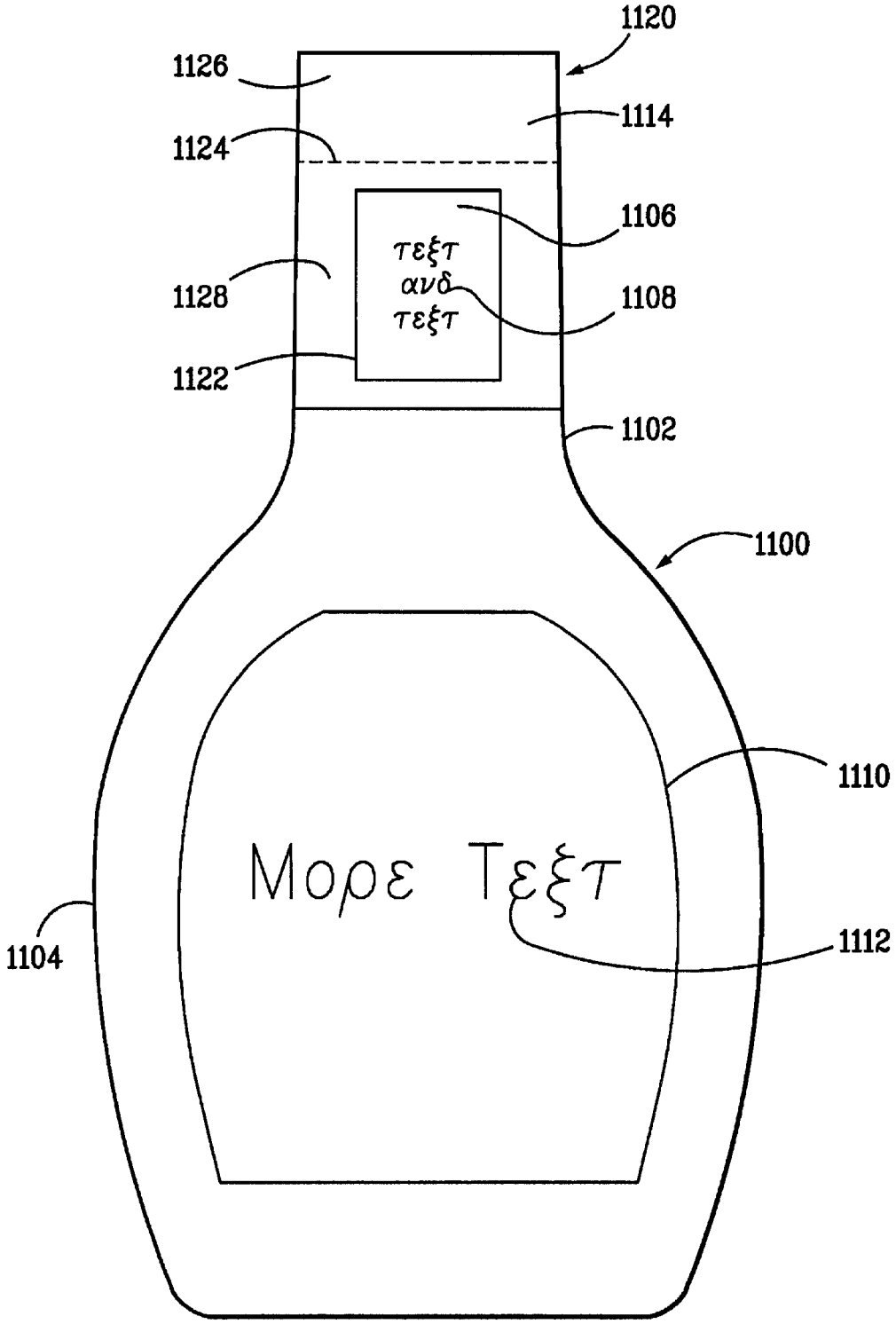
FIG. 11 is a front view of another embodiment of the rotatable label system, wherein a shell is heat shrunk about a neck of a container.

FIG. 11 shows a front view of another embodiment of the label system of the present invention. A container 1100 comprises a neck 1102 which expands downwardly and outwardly into a body 1104. An inner label 1106 with written indicia 1108 disposed thereon is affixed to the neck 1102 of the container 1100. Additional written indicia 1112 may be disposed on a label 1110 affixed to the body 1104 of the container 1100.

A shell 1120 is heat shrunk about the neck 1102 of the container 1100. The shell 1120 comprises a horizontal perforation line 1124 which divides the shell into a tamper-evident portion 1126 and a rotatable label portion 1128. Similar to previous embodiments, an upper margin (not shown) of the tamper-evident portion 1126 covers at least part of a top surface of a cap 1114, thus requiring the tamper-evident portion 1126 to be detached from the rotatable label portion 1128 before the cap may be removed.

The tamper-evident portion 1126 may be affixed to the cap 1114 for co-rotation therewith such that turning the cap in a counter-clockwise direction relative to the neck 1102 causes the tamper-evident portion 1126 to separate from the shell 1120. Once the tamper-evident portion 1126 is detached from the shell 1120, the rotatable label portion 1128 remains rotatably disposed about the neck 1102. The rotatable label portion 1128 is prevented from moving downward by the flared taper of the body 1104 immediately below the neck 1102. In an alternative embodiment, a diameter of the cap 1114 is larger than a diameter of the neck 1102, thus preventing the upward longitudinally movement of the shell 1200 when the cap 1114 is removably secured to the container 1100.

As with the foregoing embodiments, the rotatable label portion 1128 is provided with a transparent window 1122 through which an underlying subset of the written indicia 1108 disposed on the inner label 1106 may be viewed. The user selects which subset of indicia 1108 he or she wishes to view by rotating the rotatable label portion 1128 such that the selected subset of indicia 1108 appears within the window 1122.

Figure 12B:
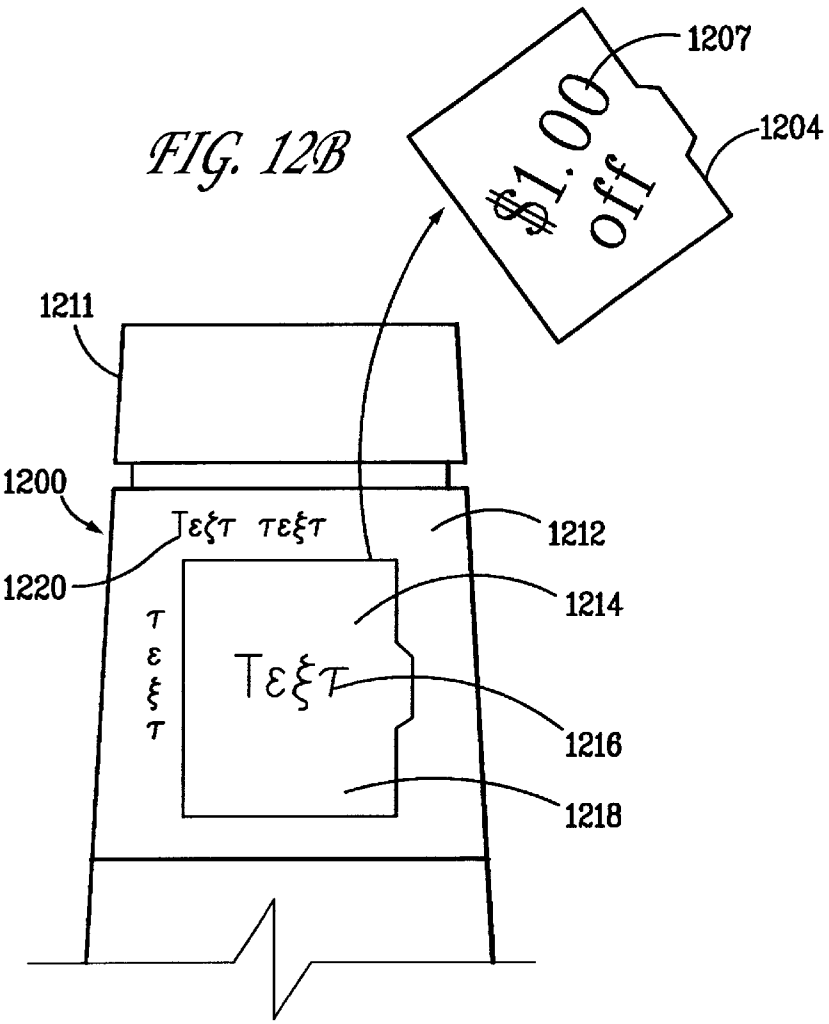
FIG. 12*b* is a front view of the rotatable label system of FIG. 12*a*, showing the detachable portion removed.
Figure 12A:
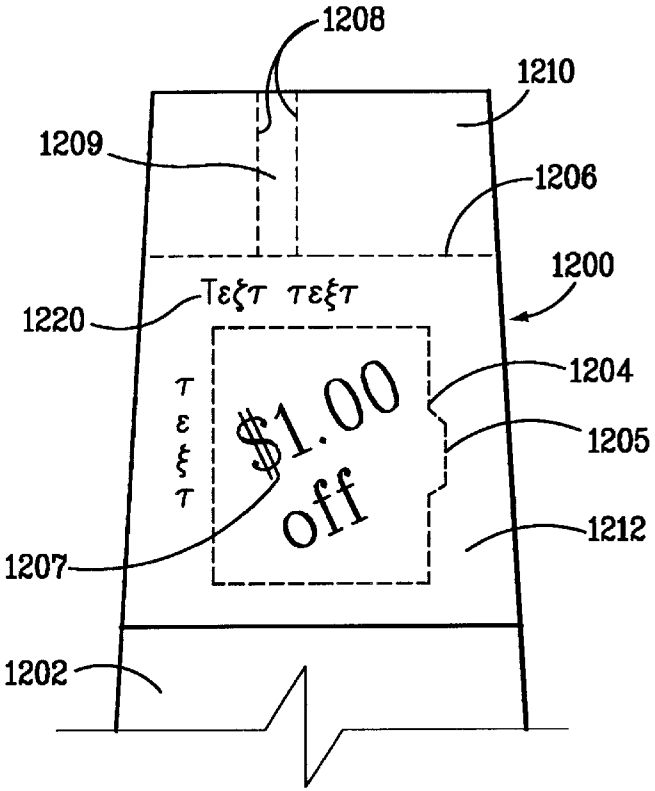
FIG. 12*a* is a front view of another embodiment of the rotatable label system, wherein a detachable portion of a rotatable label portion is removed to form a window.

FIG. 12*a* shows another embodiment of the rotatable label system having a shell 1200 disposed about a neck 1202 of a container. As in the FIG. 11 embodiment, the shell 1200 is provided with a horizontal perforation line 1206 dividing the shell into a tamper-evident portion 1210 and a rotatable label portion 1212. The rotatable label portion 1212 has written indicia 1220 disposed thereon and is further provided with a detachable portion 1204 defined by a set of perforation lines 1205. The detachable portion 1204 may have indicia 1207 arranged thereon.

A window 1218 is formed by removing the detachable portion 1204 from the rotatable label portion 1212, thereby creating an open area in the rotatable label portion (or, alternatively, uncovering a transparent portion of the rotatable label). Once the detachable portion 1204 has been removed, the user may view an underlying subset of indicia 1216 arranged on the exterior of the neck 1202, as shown in FIG. 12*b*. The user may select a desired subset of written indicia 1216 by rotating the rotatable label portion 1212 about the neck 1202.

Figure 13A:
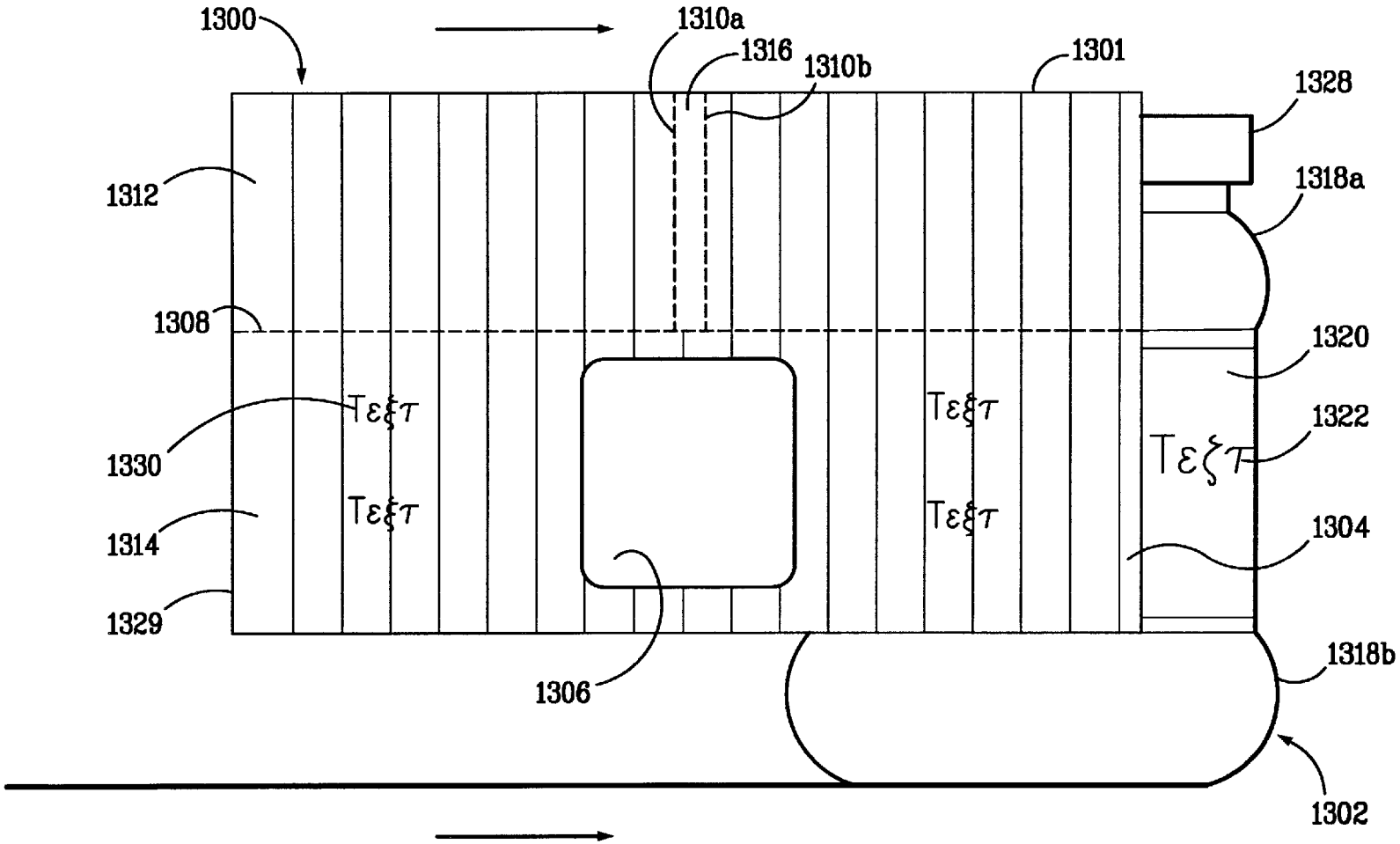
FIG. 13*a* is a front view of a heat-shrinkable sheet and container, illustrating an initial step of an alternative method for constructing the rotatable label system.
Figure 13B:
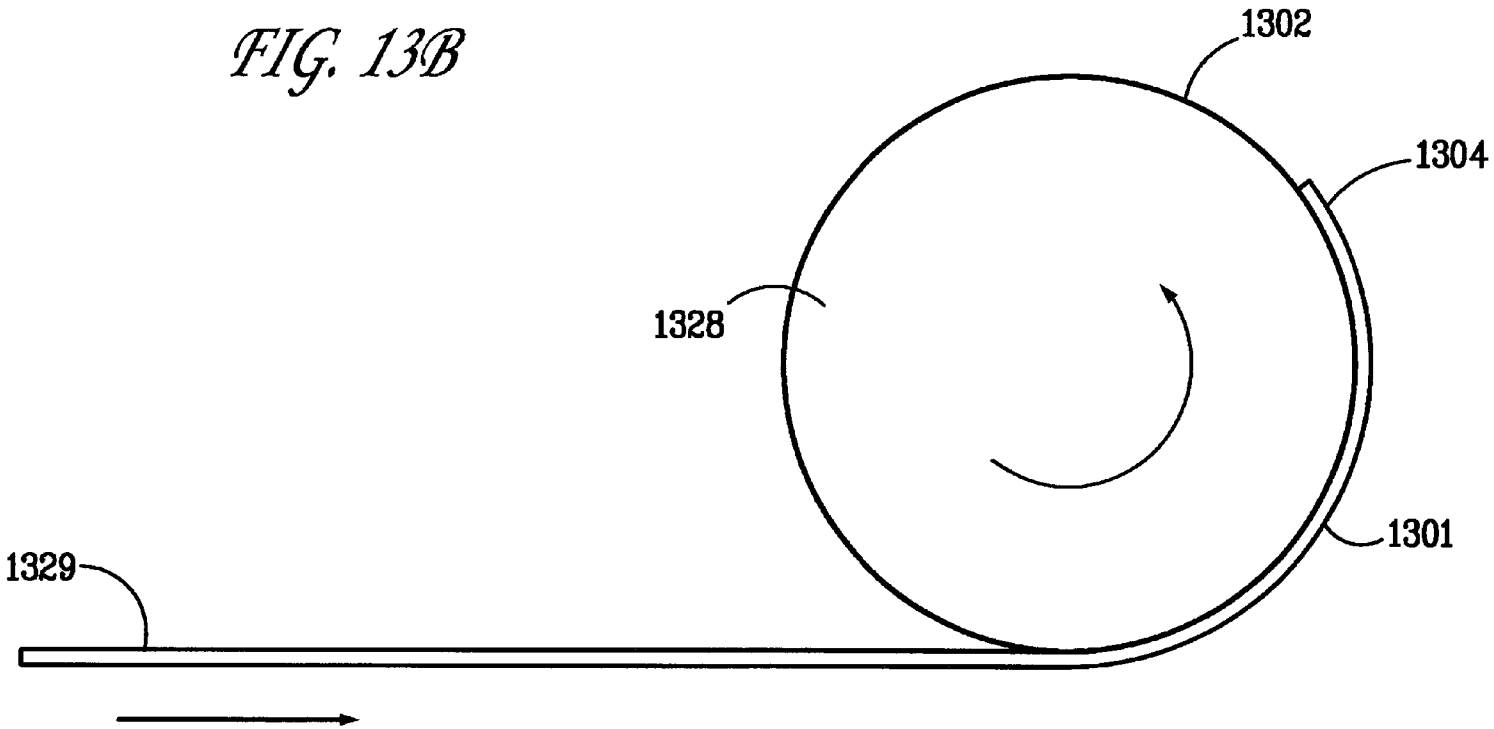
FIG. 13*b* is a top plan view of the heat-shrinkable sheet partially wrapped around the container.
Figure 13D:
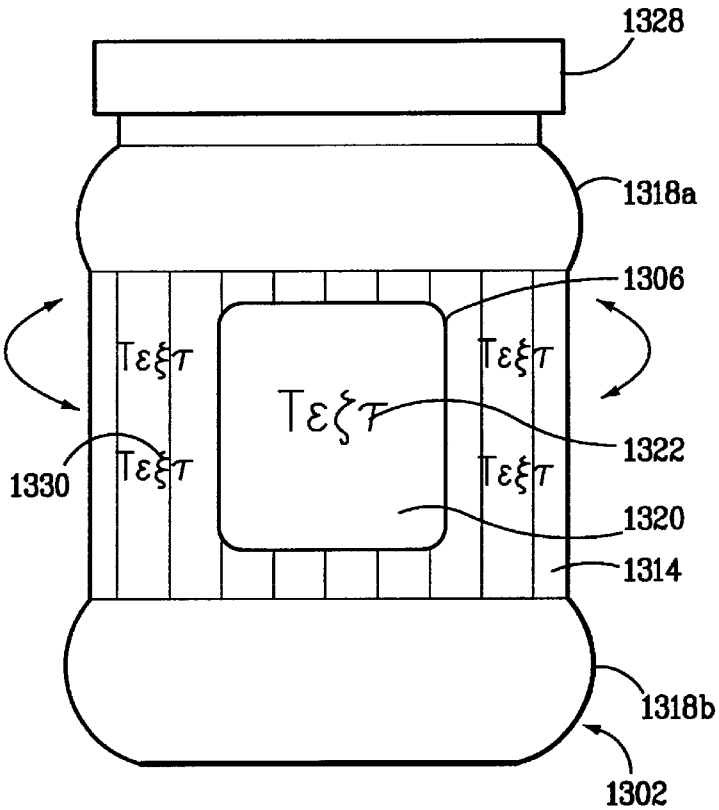
FIG. 13*d* is a front view of the shell of FIG. 13*c* with a tamper-evident portion removed from the shell.
Figure 13C:
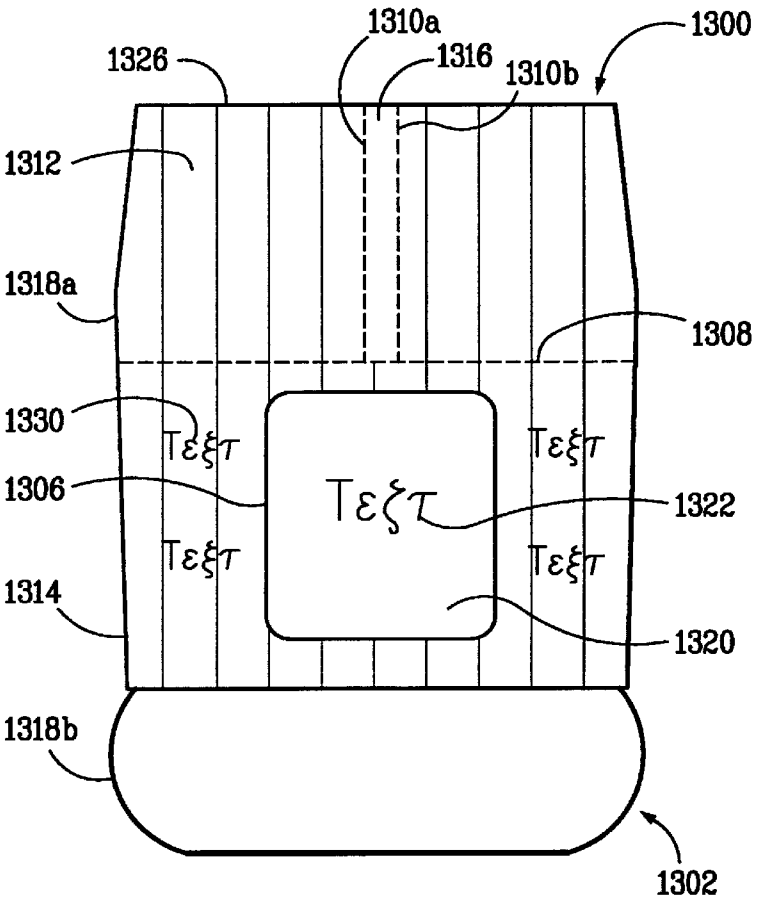
FIG. 13*c* is a front view of the end product of the alternative construction method, showing a shell heat shrunk about the container.

FIGS. 13*a–c* depict an alternative method of constructing a rotatable label system, wherein a flat, generally rectangular sheet 1301 of heat-shrinkable material is wrapped around a container 1302 to form the shell 1300. This method enables roll-feeding of the shell material, which may improve the efficiency and reduce the costs associated with manufacturing the rotatable label system of the present invention.

The sheet 1301 is adapted with a horizontal perforation line 1308 dividing the sheet 1301 into a tamper-evident portion 1312 and a rotatable label portion 1314. Vertical perforation lines 1310*a* and 1310*b* extend from the horizontal perforation line 1308 to an upper edge of the sheet 1301. The rotatable label portion 1314 has written indicia 1330 arranged thereon and is further provided with a transparent window 1306.

As depicted in FIG. 13*a*, a leading edge 1304 of the sheet 1300 is initially contacted with the container 1302 and reversibly bonded or otherwise temporarily affixed thereto such that the leading edge 1304 is held stationary relative to the container 1302 during construction of the rotatable label system. There are several techniques which may be utilized to temporarily affix the leading edge 1304 to the container 1302. A first method involves disposing a low-adhesion glue on the leading edge 1302 and/or on the adjacent surface of the container 1302. The bond thus formed is of sufficient strength to hold the leading edge 1302 stationary during the manufacturing process, but may be easily broken by a user by application of a rotational force to the rotatable label portion 1314. Another method involves wetting the leading edge 1304 and/or container to form a temporary bond, which is released when the wetting agent evaporates. Yet another method of securing the leading edge 1304 to the container 1302 is to generate a partial vacuum in a volume between the leading edge 1304 and the container 1302. Those skilled in the art will recognize that many other techniques may be employed to maintain the leading edge 1304 stationary relative to the container 1302.

FIG. 13*a* also shows the container 1302 having an upper boundary element 1318*a*, a lower boundary element 1318*b*, and an inner label 1320 with written indicia 1322 disposed thereon. The inner label 1320 is affixed on a recessed surface 1330 located between the upper boundary element 1318*a* and the lower boundary element 1318*b*. Alternatively, the written indicia 1322 may be disposed directly on the container 1302 exterior surface. A cap 1328 is also removably secured to the container 1302.

While the leading edge 1304 of the sheet 1301 is held stationary relative to the container 1302, the remainder of the sheet 1301 is wrapped around the circumference of the container 1302, as depicted in FIG. 13*b*. Wrapping of the sheet 1301 around the container 1302 may be advantageously accomplished by rotating the container (in the direction indicated by the arrow) while linearly feeding the sheet 1301. When the container 1302 has been rotated about its full circumference, the leading edge 1304 meets or is placed in overlapping relation with a trailing edge 1329, thereby forming the shell 1300. The trailing edge 1329 is preferably coated with an adhesive for securing the trailing edge 1329 to the overlapped region of the shell 1300. Heat may then be applied to the shell 1300 to cause it to shrink and conform to the container 1302.

FIG. 13*c* illustrates the end product of the foregoing label system construction technique. The shell 1300 shown conforms to contours of the upper boundary element 1318*a* of the container 1302. Additionally, the horizontal perforation line 1308 is arranged such that it is located immediately below the upper boundary element 1318*a*. The top edge 1326 and an upper margin (not shown) of the shell 1300 contracts over an edge of the cap 1328 such that the upper margin covers a portion of a surface of the cap 1328.

The upper margin now prevents the removal of the cap 1328 without the prior detachment of the tamper-evident portion 1312 of the shell 1300. The tamper-evident portion 1312 may be removed by twisting the tamper-evident portion 1312 relative to the rotatable label 1314. Alternatively, the tamper-evident portion 1312 may be detached by first removing the perforation portion 1316 along the vertical perforation lines 1310*a* and 1310*b*. Once the perforation portion 1316 is removed, the remainder of the tamper-evident portion 1312 becomes easily detachable from about the container 1302.

FIG. 13*d* shows the present embodiment with the tamper-evident portion 1312 detached from the rotatable label 1314 of the shell 1300. The rotatable label portion 1314 is located adjacent to the recessed surface 1330 between the upper and lower boundary elements 1318*a* and 1318*b*. These upper and lower boundary elements 1318*a* and 1318*b* prevent the rotatable label 1318 from longitudinally movement with respect to the container 1302.

With the tamper-evident portion 1312 detached from the shell 1300, the rotatable label 1314 is free to rotate relative to the container 1302. By turning the rotatable label 1314 relative to the container 1302, the user may view selected subsets of underlying written indicia 1322 disposed on the inner label 1320.

The invention has been described above with references to specific embodiments. It will be apparent to those skilled in the art that various modifications may be made and other embodiments can be used without departing from the broader scope of the invention. Therefore, these and other variations upon the specific embodiments are intended to be covered by the present invention, which is limited only by the appended claims.

What is claimed is:

1. A rotatable label system, comprising:

a container having first indicia arranged about an exterior of said container;

a closure removably secured to said container;

a shell of heat-shrinkable material disposed about said container and generally conforming thereto, said shell including a rotatable label portion and a tamper-evident portion;

said tamper-evident portion extending over at least part of said closure to prevent removal of said closure from said container; and said rotatable label portion having second indicia arranged thereon and further having a transparent window through which co-located first indicia may be viewed, said rotatable label portion being rotatable relative to said container about a central vertical axis thereof.

2. The rotatable label system of claim 1, wherein said container is shaped to inhibit vertical displacement of said rotatable label portion relative to said container.

3. The rotatable label system of claim 2, wherein said container includes a shoulder portion and a tapering portion extending downwardly from said shoulder portion.

4. The rotatable label system of claim 2, wherein said container comprises a neck and a body, and wherein said shell is arranged about said neck, said body having a broadened dimension thereby preventing said rotatable label from moving downwardly with respect to said container.

5. The rotatable label system of claim 2, wherein said container is adapted with top and bottom boundary elements extending circumferentially around said container, and said rotatable label portion extends between said top and bottom boundary elements, said top and bottom boundary elements having a broadened dimension to prevent longitudinal movement of said rotatable label portion with respect to said container.

6. The rotatable label system of claim 1, wherein said first indicia is disposed on an inner label affixed to said container and disposed interiorly of said shell.

7. The rotatable label system of claim 1, wherein said transparent window comprises an open area.

8. The rotatable label system of claim 7, wherein said open area is formed by detaching a predetermined section of said rotatable label portion.

9. The rotatable label system of claim 1, further comprising a release tab affixed to said shell, said release tab being configured to facilitate detachment of said tamper-evident portion from said rotatable label portion.

10. The rotatable label system of claim 1, wherein said shell includes at least one perforation line extending circumferentially about said container and detachably coupling said tamper-evident portion to said rotatable label portion.

11. The rotatable label system of claim 10, wherein said shell further comprises a second perforation line extending from said at least one perforation line to an upper edge of said tamper-evident portion.

12. A method for constructing a rotatable label system, comprising the steps of:

providing a container including a removable closure and first indicia arranged about an exterior of said container;

providing a generally cylindrical shell of heat-shrinkable material, said shell being divided into a tamper-evident portion and a rotatable label portion, said rotatable label portion having second indicia arranged thereon;

providing a transparent window in said rotatable label portion to enable viewing of an underlying subset of said first indicia;

disposing said shell about said container;

longitudinally aligning said shell with said container; and applying heat to said shell such that said shell generally conforms to said container and said tamper-evident portion covers a corresponding portion of said closure to prevent its removal, wherein said rotatable label portion is rotatable relative to said container about a vertical axis thereof.

13. The method of claim 12, wherein the step of providing said shell comprises providing at least one circumferential line of weakening coupling said rotatable label portion to said tamper-evident portion and facilitating detachment of said tamper-evident portion from said container.

14. The method of claim 12, wherein the step of providing said transparent window comprises removing a section of non-transparent material from said rotatable label portion.

15. The method of claim 12, further comprising the step of affixing a release tab to said shell to facilitate detachment of said tamper-evident portion from said rotatable label portion.

16. The method of claim 12, wherein the step of aligning comprises adjusting a vertical position of said shell such that said first indicia is properly framed by said window.

17. The method of claim 12 wherein the step of applying heat has a temperature and a duration associated therewith, said temperature and said duration being adjusted such that said rotatable label portion conforms to said container while remaining rotatable relative thereto.

18. The method of claim 12, further comprising the step of disposing a slip agent between an inner surface of said rotatable label portion and said container to ensure that said rotatable label portion may be rotated relative to said container.

19. The method of claim 12, wherein the step of providing said shell further comprises selecting said heat-shrinkable material and sizing said shell such that said rotatable label portion conforms to said container while remaining rotatable relative thereto.

20. The method of claim 12, further comprising the step of disposing an adhesive between an inner surface of said tamper-evident portion and said container to thereby inhibit rotation of said shell relative to said container prior to detachment of said tamper-evident portion.

21. A method for constructing a rotatable label system, comprising the steps of:

providing a container including a removable closure and first indicia arranged about an exterior of said container;

providing a flat sheet of heat-shrinkable material, said sheet having a tamper-evident portion and a rotatable label portion, said rotatable label portion having second indicia arranged thereon and at least one transparent window for viewing co-located first indicia;

contacting a leading edge of said sheet with said container such that said leading edge is aligned with a longitudinal axis of said container;

maintaining said leading edge stationary with respect to said container;

wrapping said sheet around said container such that a trailing edge of said sheet overlaps said leading edge, thereby forming a shell surrounding at least a portion of said container; and applying heat to said shell such that said shell generally conforms to said container and said tamper-evident portion covers a corresponding portion of said closure to prevent its removal, wherein said rotatable label portion is rotatable relative to said container about a vertical axis thereof.

22. The method of claim 21, wherein the maintaining step comprises wetting said leading edge to form a reversible bond with an adjacent portion of said container.

23. The method of claim 21, wherein the maintaining step comprises generating a partial vacuum in a volume between said leading edge and said container.

24. The method of claim 21, wherein the maintaining step comprises reversibly adhering said leading edge to said container.

25. A rotatable label system for use in connection with a container having a removable closure and first indicia arranged on the exterior of said container, said label system comprising:

a shell of heat-shrinkable material adapted to be disposed about said container and generally conforming thereto, said shell including a rotatable label portion and a tamper-evident portion;

wherein said tamper-evident portion is adapted to extend over at least part of said closure to prevent removal of said closure from said container; and wherein said rotatable label portion has second indicia arranged thereon and further has a transparent window through which co-located first indicia may be viewed, said rotatable label portion being rotatable relative to said container about a central vertical axis thereof.

26. The rotatable label system of claim 25, wherein said transparent window comprises an open area.

27. The rotatable label system of claim 26, wherein said open area is formed by detaching a non-transparent section of said rotatable label portion.

28. The rotatable label system of claim 25, further comprising a release tab affixed to said shell, said release tab being configured to facilitate detachment of said tamper-evident portion from said rotatable label portion.

29. The rotatable label system of claim 25, wherein said shell includes at least one perforation line extending circumferentially about said container and detachably coupling said tamper-evident portion to said rotatable label portion.

30. The rotatable label system of claim 29, wherein said shell further comprises a second perforation line extending from said at least one perforation line to an upper edge of said tamper-evident portion.

* * * * *